United States Patent [19]

Bessette

[11] Patent Number: 4,543,888

[45] Date of Patent: Oct. 1, 1985

[54] CONVERTIBLE HOPPER CAR

[75] Inventor: Richard P. Bessette, Blue Island, Ill.

[73] Assignee: Modine Manufacturing Company, Racine, Wis.

[21] Appl. No.: 509,817

[22] Filed: Jun. 29, 1983

[51] Int. Cl.[4] ..... B61D 39/00; B61D 17/12

[52] U.S. Cl. ..... 105/377; 52/45; 52/55

[58] Field of Search ..... 105/377, 378; 52/45–47, 51, 54, 55; 403/323, 330, 405, 406; 292/54, 202, 204, 205, 17, 19

[56] References Cited

U.S. PATENT DOCUMENTS

| | | | |
|---|---|---|---|
| 344,473 | 6/1886 | Bond | 292/202 |
| 417,126 | 12/1889 | Whitehead | 105/377 |
| 1,344,322 | 6/1920 | Walker | 105/377 |
| 1,348,515 | 8/1920 | Otis | 105/377 |
| 2,997,967 | 8/1961 | Malapert | 105/377 |
| 3,132,600 | 5/1964 | Allard | 105/262 |
| 3,734,551 | 5/1973 | Hughes et al. | 292/17 |
| 3,736,883 | 6/1973 | Yang et al. | 105/377 |
| 4,324,189 | 4/1982 | Roldness | 105/378 |
| 4,368,674 | 1/1983 | Wiens et al. | 105/377 |
| 4,377,058 | 3/1983 | Hallam et al. | 105/377 X |
| 4,435,010 | 3/1984 | Mandel | 105/377 X |

*Primary Examiner*—Robert B. Reeves
*Assistant Examiner*—Mark J. Abate
*Attorney, Agent, or Firm*—Wood, Dalton, Phillips, Mason & Rowe

[57] ABSTRACT

A convertible railway hopper car has parallel longitudinal beams defining the sides of a hatchway for filling the car with granular material from a spout, and hinged on the upper margins of the car sidewalls are cargo cover members which may occupy elevated positions in which they form a roof covering the entire car body except the hatchway, or idle positions hanging inside the car body. Hinged hatch elements are mounted on the cargo cover members at one side of the hatchway and are movable between extended positions closing the hatchway and secured to the cargo cover members at the other side of the hatchway, and open positions lying atop the cargo cover members upon which they are mounted. When the cargo cover members are in idle position the hatch elements hang below them.

20 Claims, 10 Drawing Figures

CONVERTIBLE HOPPER CAR

BACKGROUND OF THE INVENTION

There is a substantial need in the moving of bulk cargoes by railway hopper cars for a car which may be used either for bulk cargoes which need protection from weather or those which do not. Many of the bulk cargoes which need protection from weather are food or feed grains, all of which can be loaded into a hopper car from a relatively small filler spout under a grain elevator, so that except for a loading hatchway the top of the car may be closed.

On the other hand, most of the bulk cargoes which do not need to be protected from weather consist of coarser materials such as coal, stone or the like, which cannot be handled through a loading spout and which thus require a completely open top hopper car for loading.

There have been a number of attempts to provide a satisfactory convertible railway hopper car; but insofar as applicant is aware none of them has met with any commercial success. U.S. Pat. Nos. 4,117,126, 1,344,322, and 3,132,600 all disclose railway cars having movable roof panels which, when they are not in position to form a roof over the car and to cover the interior of the car, are pivoted to hang outside the sidewalls of the car. A fundamental problem with all such constructions is that when the roof panels are hanging outside the car sidewalls they necessarily decrease the clearance between the cars; and in order to maximize car capacity most railway freight cars, including hopper cars, are made as wide as railroad clearance regulations permit.

U.S. Pat. No. 2,997,967 illustrates another approach to the problem, with roof sections that roll up at one or both ends of the car, in the manner of a roll-top desk. Any such roll-up roof which is to be structurally strong enough for railroad use produces very large and awkward bundles at the ends of the car when the roof is rolled up, and also requires considerable power to roll it up.

U.S. Pat. No. 3,736,883 discloses a third approach, in which roof panels are hinged on the beams that define the sides of a center loading hatchway, and the roof panels occupy upright positions when they are not laterally extended to cover the car body. In the upright position the panels may cause clearance problems. Insofar as applicant is aware, the Pullman Company, which owns U.S. Pat. No. 3,736,883, has never sold a car embodying the structure of the patent.

SUMMARY OF THE INVENTION

The principal purpose of the present invention is to provide a convertible railway hopper car of a novel construction which eliminates the shortcomings of the prior art structures.

In accordance with the invention, a railway hopper car is provided with first and second sets each consisting of a plurality of cargo cover members each of which has parallel first and second longitudinal edges, and transverse edges, with the first longitudinal edges of the first and second sets being hinged, respectively, on the upper margins of first and second sidewalls of a hopper car for movement of the cargo cover members between elevated positions in which they cooperate to entirely cover the car body except for a center hatchway, and idle positions hanging inside the car body. In their elevated positions the second longitudinal edges abut longitudinal beams which define the sides of the hatchway, and movable hanger means releasably support the second edge of each cargo cover member on one of the longitudinal beams.

In a most preferred embodiment each cargo cover member of the first set carries a hinged hatch element which is movable between an extended position in which all the hatch elements cooperate to close the hatchway, and an open position lying atop the cargo cover members of the first set, and when the cargo cover members are in their idle position the hatch elements hang down from the cargo cover members.

Further, in said most preferred embodiment the ends of the car have arched upper margins and the cargo cover members are curved to fit the arch of said upper margins.

The apparatus of the invention may be used to retrofit existing hopper cars by adding extra curved top panels to the ends of a conventional railway hopper car, installing the longitudinal beams which define the sides of the hatchway, and placing mounting rails on the upper margins of the car sidewalls to carry the hinged cargo cover members. Obviously, the invention is equally applicable to new railway hopper cars.

One advantage of the most preferred structure with its curved cargo cover members is that when they are in their idle positions they reduce the capacity of the car by a predetermined substantial amount, and thus help accommodate the differences in cargo weight per cubic foot for cargoes such as cereal grains and coal or stone. The greater density of the latter makes it necessary to substantially reduce the amount of such material which is loaded into a hopper car, as against the amount of cereal grain that such a car may handle.

THE DRAWINGS

DETAILED DESCRIPTION OF THE INVENTION

Figure 1:
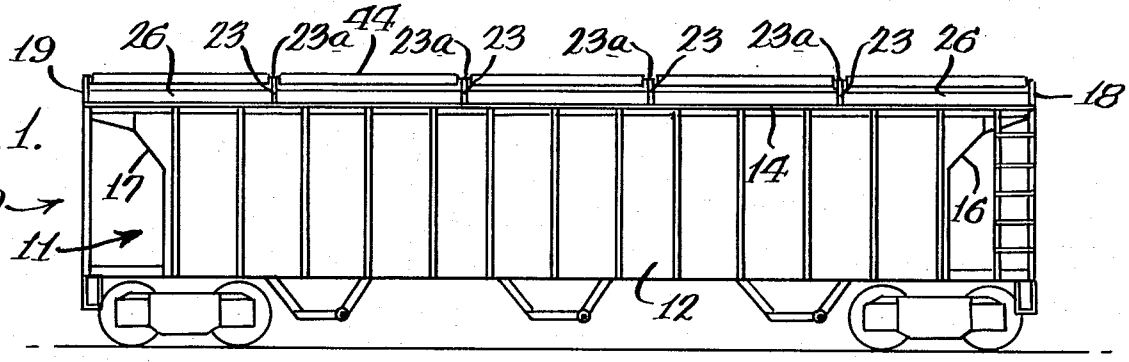
FIG. 1 is a side elevational view of a railway hopper car embodying the invention.

In accordance with the invention, a railway hopper car, indicated generally at 10, has a car body, indicated generally at 11, which consists of first and second sidewalls 12 and 13 which have respective upper margins defined by angle rails 14 and 15. End walls 16 and 17 include respective upper portions 18 and 19 consisting of plates having mounting flanges, such as the flange 18*a* seen in FIGS. 4 to 7, which seat upon and are securely fastened to flanges, such as the flange 16*a*, on the car body end walls. The upper portions 18 and 19 have lateral ends which are joined to the sidewall upper angle rails 14 and 15, and said upper portions have upper margins which arch upwardly between their ends.

Carried substantially at the upper margins of the end wall upper portions 18 and 19 are first and second parallel longitudinal beams 20 and 21 which define the sides of a hatchway 22 through which a loading spout (not shown) may fill the car with granular material. Spanning the car body at regular intervals are transverse arched structural channel elements 23 which are supported upon the sidewall angle rails 14 and 15 and are butt welded to the beams 20 and 21. Cross connectors 23*a* between the beams 20 and 21 are also butt welded to the beams, and shallow drain channels 23*b* surmount and are welded to the cross connectors 23*a*, the longitudinal beams 20 and 21, and the inner end portions of the structural channel elements 23.

Figure 3:
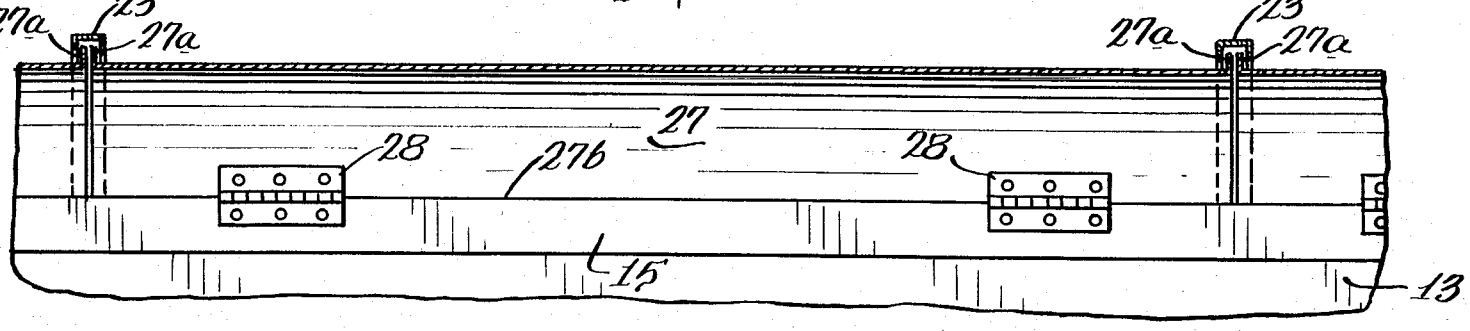
FIG. 3 is a fragmentary longitudinal sectional view on an enlarged scale taken substantially as indicated along the line 3—3 of FIG. 2.

Two sets of cargo cover members, consisting of a first set indicated generally at 24, and a second set indicated generally at 25, each consists of five cargo cover members, the individual cover members of the first set being identified as 26 and the individual cover members of the second set being identified as 27. All the cargo cover members 26 and 27 are identical, and they are fabricated from tough, impact-resistant fiberglass reinforced plastic of a type which is already used in railway car construction. As best seen in FIG. 3, each of the cargo cover members is mounted on top of a sidewall angle rail 14 or 15 by means of a pair of hinges 28, and each of the cover members has upright end flanges, such as the flanges 27*a* seen in FIG. 3, which project upwardly into the channel members 23 when the cover members are in their elevated positions as illustrated in all of the drawings except FIG. 7. The flanges 27*a* of the endmost cargo cover members are shielded by angle members 18*b* and 19*b* on the end walls 18 and 19. As seen in FIGS. 4–7, the cargo cover members 26 and 27 have respective outer longitudinal edges 26*b* and 27*b* which receive the hinges 28 so as to support the cover members; and such cargo cover members have respective inner longitudinal edges 26*c* and 27*c* which abut, respectively, the first and second longitudinal beams 20 and 21 when the cargo cover members are in their elevated positions.

Referring now to FIGS. 4–6, 9 and 10, each of the cargo cover members 26 and 27 is provided along its outer edge with a rubber sealing flap 28*a* which rests on top of the car sidewall upper angle rail, and has along its inner edge a rubber sealing strip 29*a* which projects beneath the associated longitudinal beam 20 or 21, as the case may be, when the cargo cover member is in its elevated position.

Figure 9:
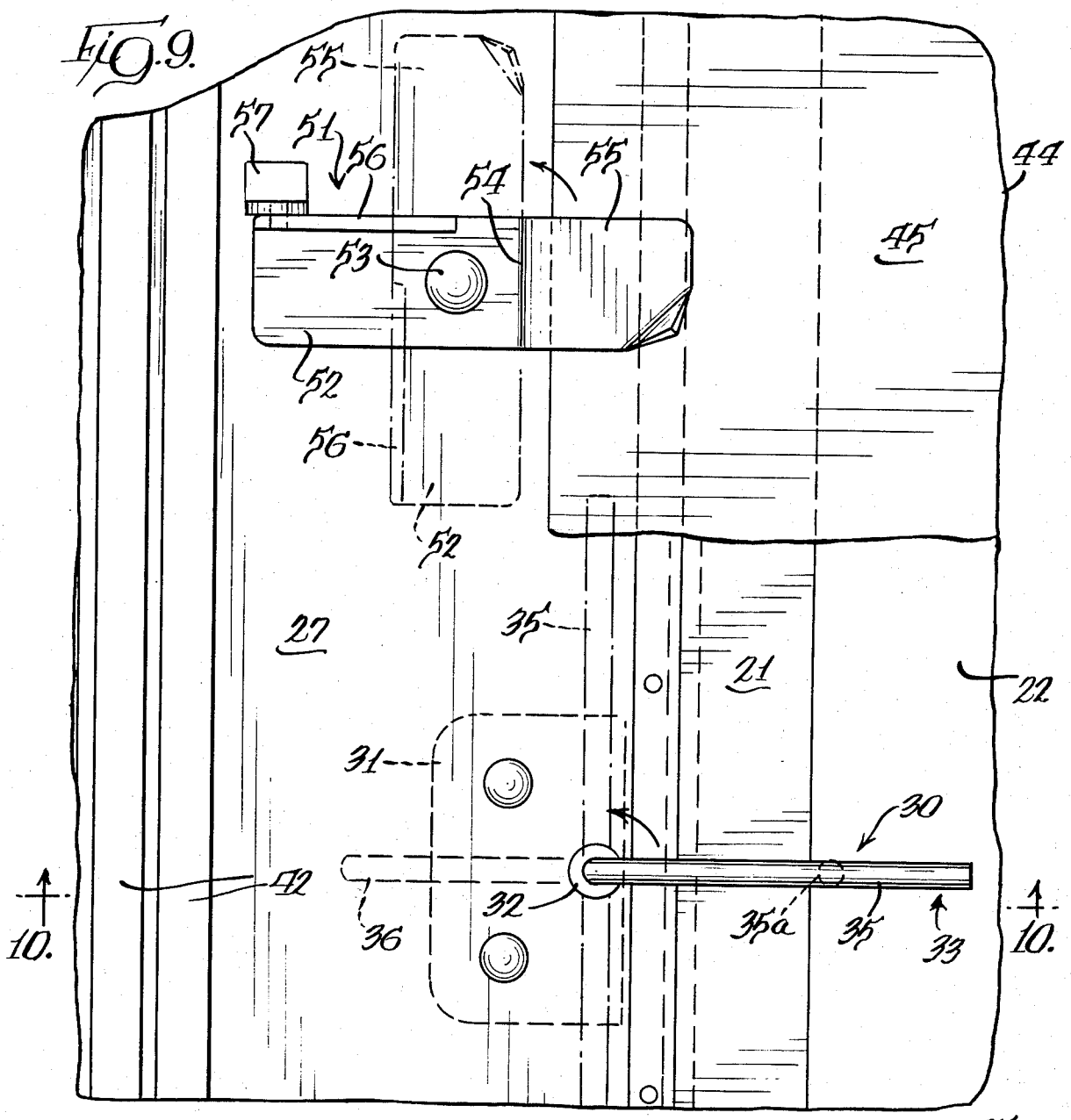
FIG. 9 is a fragmentary plan view on an enlarged scale with parts broken away for clarity.
Figure 10:
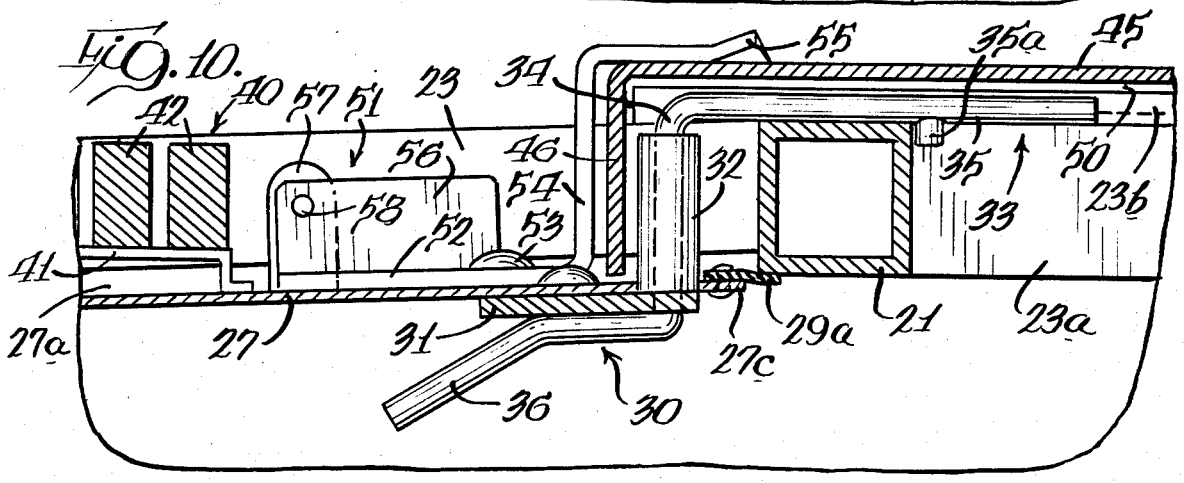
FIG. 10 is a fragmentary sectional view taken substantially as indicated along the line 10—10 of FIG. 9.

Referring now especially to FIGS. 9 and 10, each of the cargo cover members 26 and 27 is provided with a movable hanger means, indicated generally at 30, which is mounted close to the inner edge of the cover member. Each movable hanger means consists of a mounting plate 31 which is riveted to the underside of the cargo cover member and carries an upright sleeve 32 which is aligned with a hole in the mounting plate. A hanger member, indicated generally at 33, consists of a hanger pin 34 that extends through the sleeve and is rotatable therein, a hanger arm 35 on the top of the pin, and an interior hanger operating finger 36 on the bottom of the pin below the cargo cover member. The hanger member may be rotated 90° between a first position in which the hanger arm 35 rests on top of the beam 21, and a release position, indicated in broken lines in FIG. 9 and illustrated in FIG. 6, in which the hanger arm 35 is alongside the beam. The hanger member 33 may be moved either by a person who is standing upon the opposite cargo cover member and can reach across to grasp the hanger arm 35, or by a person standing in the hopper car who can reach up with a hook stick which grasps the inclined portion of the operating finger 36 to rotate the hanger member. A knob 35*a* on the hanger arm 35 is seen in FIG. 10 to extend into the hatchway alongside the beam 21 so as to prevent the hanger member 33 from turning due to car vibration; and this requires that the cargo cover member be raised slightly before the hanger member can be turned to release the cargo cover member for movement to its idle position.

Figure 2:
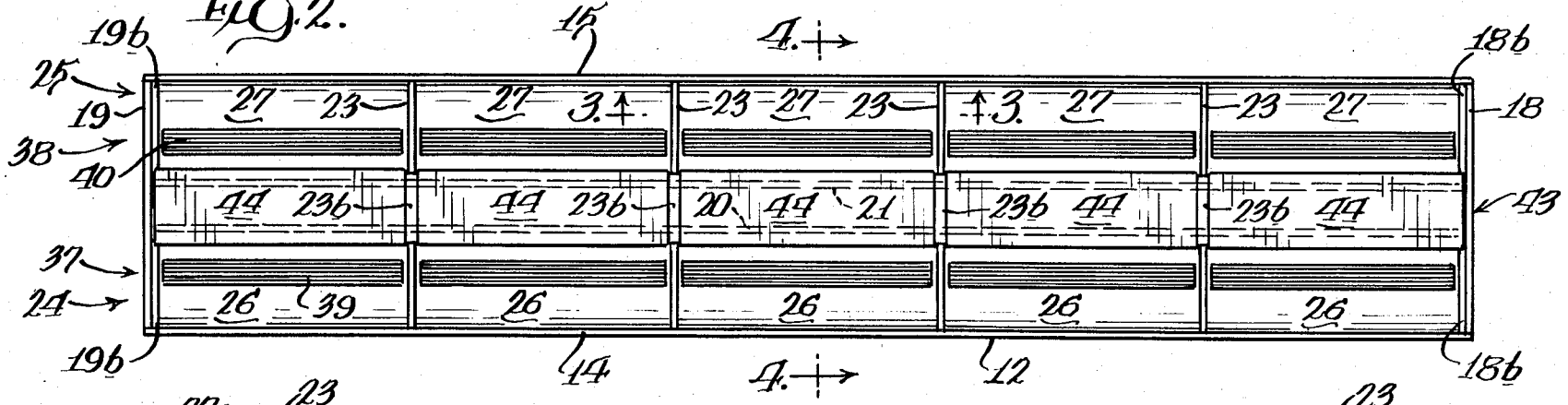
FIG. 2 is an enlarged plan view of the hopper car of FIG. 1.

Longitudinal catwalks, indicated generally at 37 and 38 in FIG. 2, surmount the respective sets 24 and 25 of cargo cover members, and each catwalk consists of a catwalk segment 39 or 40, as the case may be, mounted on the respective cargo cover members 26 and 27. Each of the catwalk segments 39 or 40 consists of two or three spaced bridge frames 41 which are fixed to the cargo cover member and carry several longitudinal catwalk cleats 42.

Referring again to FIGS. 4–8, a hatch, indicated generally at 43 in FIG. 2, consists of five hatch elements 44 consisting of a hatch plate 45 and flanges 46 and 47 which lie on opposite sides of the hatchway 22 when the hatch element 44 is in an extended position overlying the hatchway. Each of the hatch elements 44 is carried by hinges 48 that surmount hinge brackets 49 that are affixed to one of the cargo cover members 26 of the first set 24, and each of the hatch elements 44 is movable between the extended position illustrated in FIG. 4 and an open position illustrated in FIG. 5 in which the hatch element lies atop the cargo cover member upon which it is mounted, supported upon the catwalk segment.

Figure 8:
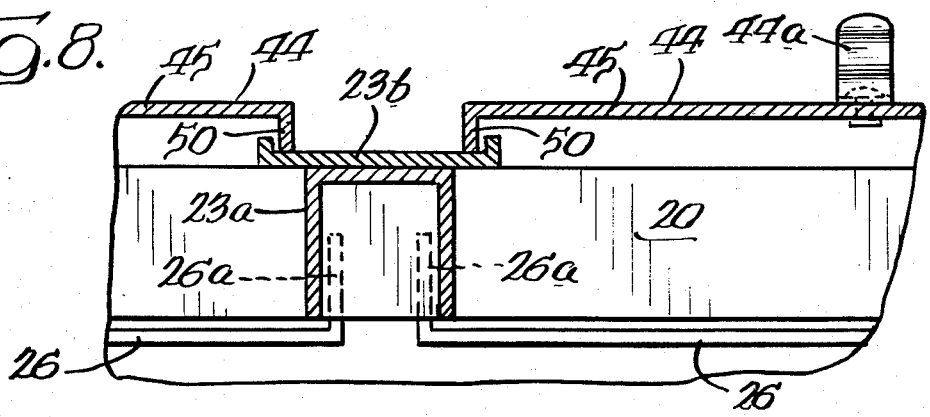
FIG. 8 is a fragmentary sectional view on an enlarged scale taken substantially as indicated along the line 8—8 of FIG. 4.

Each of the hatch elements 44 must have its ends spaced slightly from the structural elements 23 so as to be free to move between its extended position and its open position. As seen in FIG. 8, at the ends of the hatch elements 44 are skirts 50 which extend between the flanges 46 and 47 and overlie the drain channels 23*b* so as to avoid leakage into the car between the hatch elements. Drain channels on the central portions of the end walls 18 and 19 have lateral ends above the angle members 18*b* and 19*b* and receive the skirts 50 on the endmost hatch elements 44.

Referring again to FIGS. 9 and 10, mounted upon each of the cargo cover members 27 is a hatch element securing means, indicated generally at 51. The hatch element securing means consists of a base plate 52 which is mounted upon the cargo cover member 27 on a pivot 53, a riser portion 54, and a securing arm 55 which overlies the hatch element in the solid line position of FIG. 9. An upright handle piece 56 on the base plate 52 permits easy manual rotation of the hatch element securing means 51 between the solid line securing position of FIG. 9 and the broken line release position of FIG. 9. A stop 57 mounted upon the cargo cover member 27 is provided with a hole that aligns with a hole 58 in the handle 56 to receive a wire seal if required.

Figure 7:
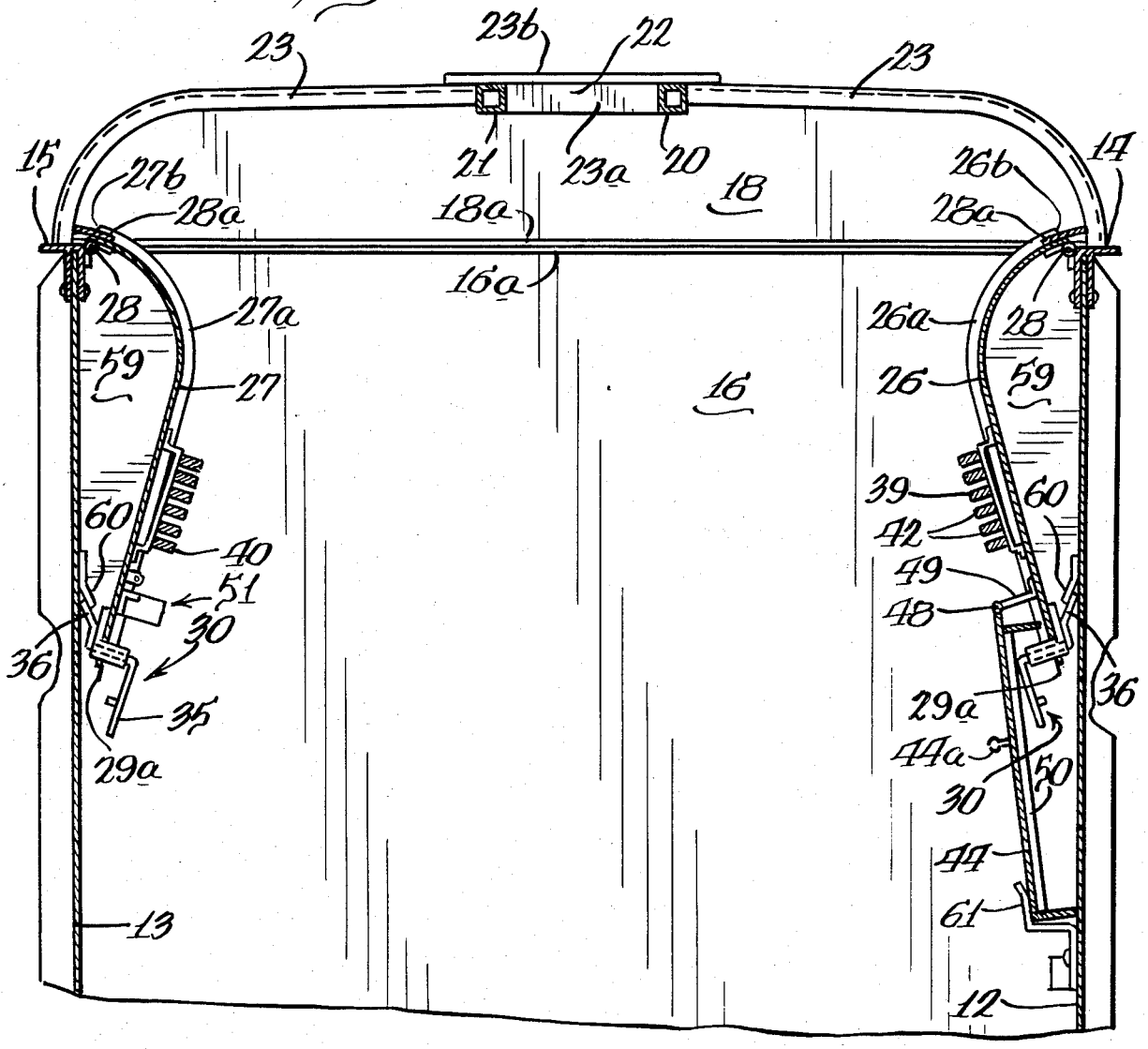
FIG. 7 is a view like FIGS. 4, 5 and 6 with the cargo cover members and hinged hatch elements in their idle positions.

Referring now to FIG. 7 which illustrates the cargo cover members and the hatch elements in their idle positions, it is seen that the sidewalls 12 and 13 are provided with interior bracing webs 59 which have curved outer faces matching the curvature of the cargo cover members 26 and 27 so as to provide support for those members when they are in their idle positions. Latch plates 60 extend diagonally inwardly from the walls 12 and 13 and may be engaged by the interior hanger operating fingers 36 of the movable hanger means 30 to fix the cargo cover members in their idle positions. At a lower level upon the sidewall 12 is a rotatable latch member 61 to fasten the hatch element 44 in its idle position.

FIG. 7 makes it apparent that the catwalk segments 39 act as shields to protect the hatch element hinges 48 and the rotatable latches 61 from damage by material being loaded into the car when the cargo cover members are in their idle positions.

Figure 4:
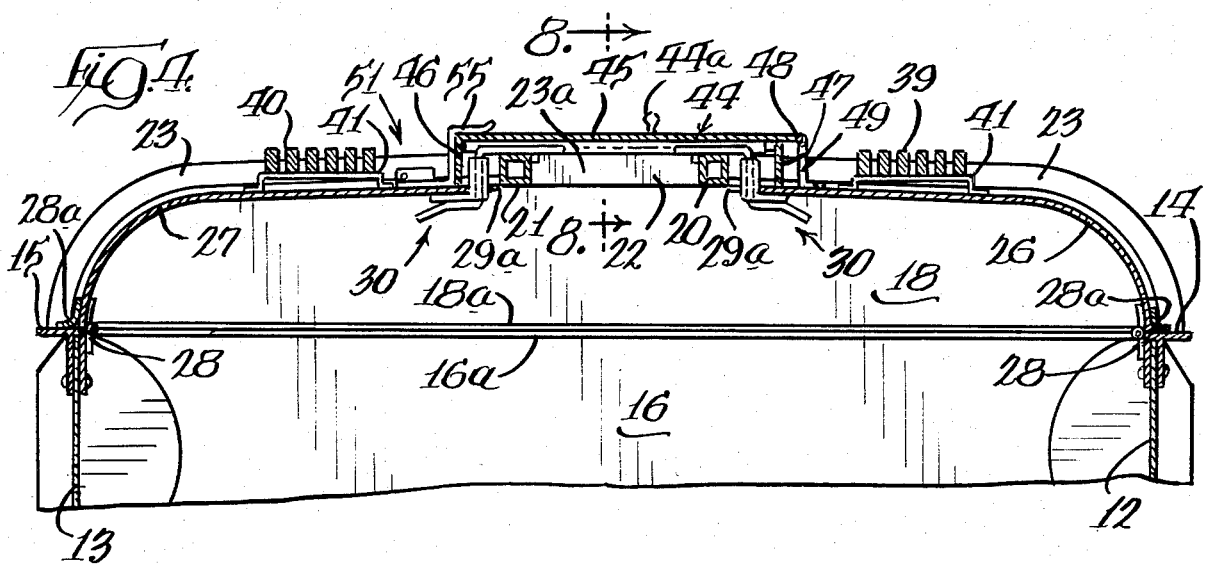
FIG. 4 is a fragmentary transverse sectional view taken substantially as indicated along the line 4—4 of FIG. 2.
Figure 5:
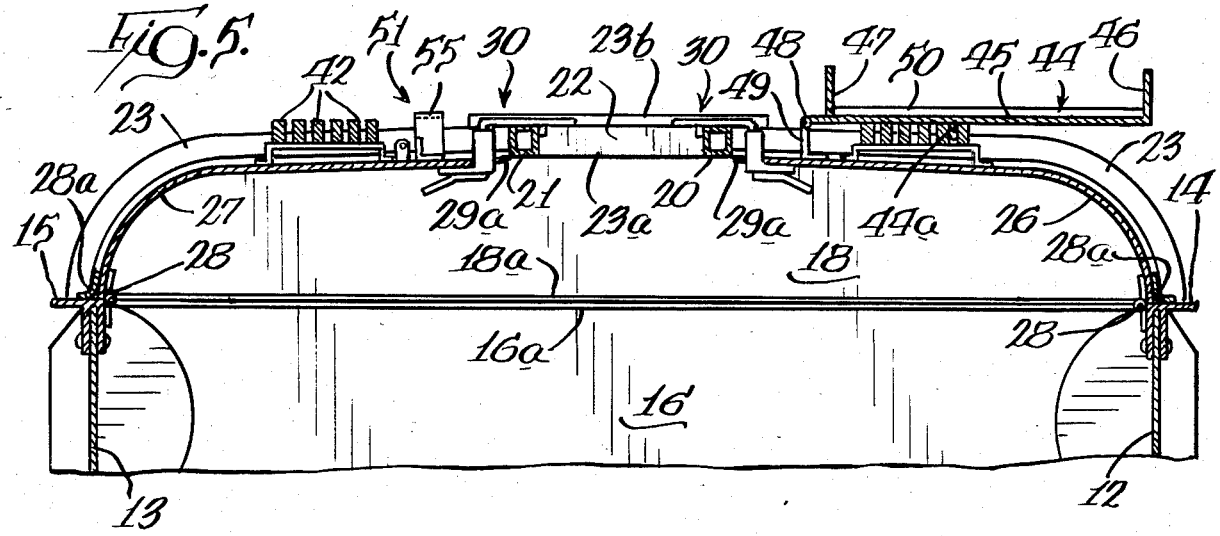
FIG. 5 is a view like FIG. 4 with the hatch elements in their open positions.
Figure 6:
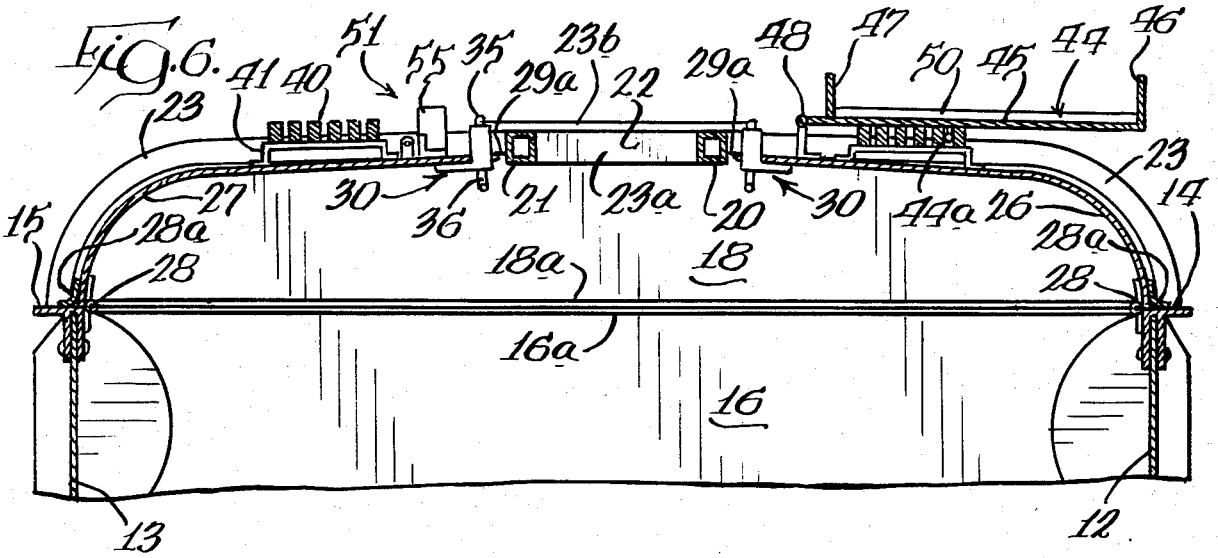
FIG. 6 is a view like FIG. 5 with the hanger means turned to the positions in which the cargo cover members are free to move to their idle positions.

When a car is to be converted from its covered condition to its uncovered condition, a workman first moves along the catwalk 40 to move the hatch element securing means 51 to their release positions, and then swing the hatch elements 44 from the position of FIG. 4 to the position of FIG. 5. The workman then moves off the catwalk 40 and releases the cargo cover member 27 at one end of the car and lowers it to its idle position, and then descends to the floor of the car on a ladder (not shown) that is fixed beneath the longitudinal beam 21. The workman may then use a manipulating pole that includes a hook to first lift the next adjacent cargo cover member 27, then rotate the hanger member 33 to its release position as illustrated in FIG. 6, and then use the pole to lower the cargo cover member in a controlled manner until he can grasp it and swing it to the position of FIG. 7. He then manipulates the hanger member 33 to engage the interior hanger operating finger 36 behind the latch plate 60. After the workman has lowered all the cargo cover members 27, he may then move to the other side and similarly lower all the cargo cover members 26, together with the hatch elements 44. In order to simplify this part of the operation, each hatch element 44 is preferably provided with friction clips **44*a* which engage between the catwalk cleats 42 so as to hold the hatch element until the hanger member can be manipulated to latch the cargo cover member 26 in its idle position, after which the hatch element is pulled manually to release it from the cleats 42 and is lowered to the depending position of FIG. 7 where it is secured by manipulating the rotatable latch 61**.

When the car is to again be converted to its covered state the above procedure is, in essence, reversed. Each manual latch 61 is first rotated to release a hatch element 44 which is manually raised to engage its friction clips **44*a* with the cleats 42 of a catwalk segment 39. The cargo cover hanger member 33 is then rotated to release the interior finger 36 from the latch plate 60, the workman raises the cargo cover member 26 far enough to get the pole under it, and then completes the operation of returning the cargo cover member to its elevated position by lifting it with the pole and manipulating the hanger member 33 by means of its interior operating finger 36 until the hanger arm 35 is properly positioned over the longitudinal beam 20. After all but the end one of the cargo cover members 27 have been raised to their elevated positions, the workman ascends the ladder and then manually lifts and secures the last cargo cover member 27**.

After the car has been filled with grain poured through the longitudinal hatchway by a spout, a workman operates from a position on top of an open hatch element 44 to release the elements one at a time from the catwalk cleats 42 and move the hatch elements to their closed positions, after which he may either reach across to fasten the hatch elements by means of the securing means 51, or may step across to the catwalk 40 to move the securing means from that side of the car.

The foregoing detailed description is given for clearness of understanding only and no limitations are to be understood therefrom, as modifications will be obvious to those skilled in the art.

I claim:

1. In a convertible railway hopper car for selectively shipping either those bulk cargoes which need protection from weather or those which do not, said car comprising a car body having first and second solid side walls and end walls with upper margins, a bottom wall including material discharge hopper means, and first and second parallel longitudinal beams carried on the end walls which define the sides of a narrow central hatchway through which a loading spout may fill the car with granular material, the improvement comprising in combination:

first and second sets each consisting of a plurality of wide cargo cover members each of which has parallel outer and inner longitudinal edges, and transverse edges, said outer longitudinal edges of said first and second sets being hinged, respectively, on the upper margins of the first and second side walls for movement of said cargo cover members between elevated positions in which the inner longitudinal edges of the first and second sets abut, respectively, the first and second longitudinal beams, and idle positions hanging inside the car body, and said cargo cover members in their elevated positions cooperating to form a roof which entirely covers the car body except for the hatchway;

hanger means for supporting said inner edge of each cargo cover member on a longitudinal beam, said hanger means being movable between an engaged supporting position and a disengaged position in which each cargo cover member is entirely free of any connection to a longitudinal beam so it may swing freely to its idle position;

a set of hatch elements;

hinge means mounting all of said hatch elements at the side of the hatchway adjacent the cargo cover members of the first set, for movement between an extended position in which they cooperate to entirely cover the hatchway and an open position lying atop said cargo cover members of the first set, and said hatch elements having an idle position hanging generally vertically inside the car body when the cargo cover members are in their idle position; and securing means for fastening the hatch elements in said extended position.

2. The combination of claim 1 in which the end walls have upper portions above a horizontal plane that includes the upper margins of the side walls, said upper portions have lateral ends which are at the sidewalls substantially on said horizontal plane and upper margins which arch upwardly between said ends, the longitudinal beams are carried substantially at said upper margins of said upper portions of the end walls, and the cargo cover members are curved between their longitudinal edges to conform substantially to the arch of said upper margins of the end walls.

3. The combination of claim 2 in which said upper portions of the end walls are separate from the rest of the end walls and are affixed thereto, and the upper margins of the sidewalls are defined by structural rails which are separate from the rest of the sidewalls and are affixed thereto.

4. The combination of claim 2 which includes upright bracing webs on the inside of the sidewalls, said webs having curved margins that match the curve of the cargo cover members to brace the latter in their idle positions.

5. The combination of claim 2 in which the curved cargo cover members project inwardly from the sidewalls in their idle positions so as to materially reduce the cargo capacity of the hopper car to a predetermined extent, and means are provided to brace said cargo cover members in said idle position.

6. The combination of claim 1 in which each of the hatch elements is hinged on one of the cargo cover members of the first set, and said hatch elements hang downwardly from said cargo cover members of the first set when the latter are in their idle positions.

7. The combination of claim 6 which includes manual latches on the interior of the first sidewall to fix the hatch elements when the cargo cover members are in their idle positions.

8. The combination of claim 1 which includes latch plates on the interior of the sidewalls which interengage with the movable hanger means to fix the cargo cover members in their idle positions.

9. The combination of claim 1 which includes a longitudinal catwalk comprising a catwalk segment surmounting each cargo cover member of the second set.

10. The combination of claim 9 which includes a second longitudinal catwalk comprising a catwalk segment surmounting each cargo cover member of the first set.

11. The combination of claim 1 in which each hanger means comprises an upright sleeve on a cargo cover member, a hanger pin extending through said sleeve and rotatable therein, a hanger arm on the top of the pin which rests on a beam in one position of the hanger pin and lies alongside said beam in another position of said hanger pin, and an interior hanger operating finger on the bottom of the pin below the cargo cover member, said operating finger being adapted to be engaged to rotate the pin.

12. The combination of claim 11 in which the shape of the hanger operating finger is such that it may be engaged by a hooked stick manipulated by a person standing in the car body.

13. The combination of claim 6 which includes transverse structural elements, each of said transverse structural elements including portions which overlie the adjacent transverse edges of two cargo cover members of a set so as to provide a rain shield, in which each hatch element has transverse edges which clear the transverse structural elements at the transverse edges of the cargo cover member on which the hatch element is mounted, and in which the transverse structural elements also include parts providing drain channels for the transverse edges of the hatch elements.

14. The combination of claim 13 in which the end walls have upper portions above a horizontal plane that includes the upper margins of the side walls, said upper portions have lateral ends which are at the sidewalls substantially on said horizontal plane and upper margins which arch upwardly between said ends, the longitudinal beams are carried substantially at said upper margins of said upper portions of the end walls, and the cargo cover members are curved between their longitudinal edges to conform substantially to the arch of said upper margins of the end walls.

15. The combination of claim 13 in which the transverse structural elements are channel members which are downwardly open, and there are upright flanges on the transverse edges of the cargo cover members which extend into said channel members.

16. The combination of claim 1 in which the hatch element securing means are on the cargo cover members of the second set.

17. The combination of claim 13 which includes flanges on the two end walls which overlie the endmost transverse edges of the four endmost cargo cover members so as to provide rain shields, and which also includes drain channels on said end walls for the endmost transverse edges of the endmost hatch elements.

18. The combination of claim 1 which includes flexible rubber sealing flaps along the outer longitudinal edges of all the cargo cover members which overlie the upper margins of the sidewalls when the cargo cover members are in their elevated positions.

19. The combination of claim 18 which includes flexible rubber sealing strips along the inner longitudinal edges of all the cargo cover members which underlie the longitudinal beams when the cargo cover members are in their elevated positions.

20. The combination of claim 6 which includes a longitudinal catwalk comprising a catwalk segment surmounting each cargo cover member of the first set, each of said catwalk segments comprising a plurality of closely spaced catwalk cleats, and in which each hatch element is provided with friction clips which engage between the catwalk cleats when the hatch elements are in their open positions lying atop the cargo cover members of the first set.

* * * * *

UNITED STATES PATENT AND TRADEMARK OFFICE

CERTIFICATE OF CORRECTION

PATENT NO. : 4,543,888

DATED : October 1, 1985

INVENTOR(S) : Richard P. Bessette

It is certified that error appears in the above-identified patent and that said Letters Patent is hereby corrected as shown below:

On the title page the following should be deleted:

"[73] Assignee: Modine Manufacturing Company, Racine, Wis."

Signed and Sealed this

*Seventeenth* Day of *December 1985*

[SEAL]

*Attest:*

DONALD J. QUIGG

*Attesting Officer*

*Commissioner of Patents and Trademarks*